US011167220B2

(12) United States Patent
Sifferlin et al.

(10) Patent No.: US 11,167,220 B2
(45) Date of Patent: Nov. 9, 2021

(54) REUSABLE, ANCHORABLE ORNAMENTAL BALLOON STRUCTURE

(71) Applicant: Anagram International, Inc., Eden Prairie, MN (US)

(72) Inventors: Mark S. Sifferlin, Edina, MN (US); Paul J. Sable, Crystal, MN (US)

(73) Assignee: Anagram International, Inc., Eden Prairie, MN (US)

( * ) Notice: Subject to any disclaimer, the term of this patent is extended or adjusted under 35 U.S.C. 154(b) by 0 days.

(21) Appl. No.: 16/828,151

(22) Filed: Mar. 24, 2020

(65) Prior Publication Data

US 2021/0299585 A1 Sep. 30, 2021

(51) Int. Cl.
*A63H 27/10* (2006.01)
*A63G 31/12* (2006.01)

(52) U.S. Cl.
CPC ..... *A63H 27/10* (2013.01); *A63H 2027/1008* (2013.01); *A63H 2027/1033* (2013.01); *A63H 2027/1075* (2013.01); *A63H 2027/1083* (2013.01)

(58) Field of Classification Search
CPC .. A63G 31/12; A63H 3/06; A63H 2027/1008; A63B 69/20
USPC ..... 472/134; 446/220–221, 223, 226
See application file for complete search history.

(56) References Cited

U.S. PATENT DOCUMENTS 2,665,519 A * 1/1954 Burkes ..... A63H 3/06 472/129
4,917,646 A 4/1990 Kieves
5,152,092 A * 10/1992 O'Brien ..... E01F 9/688 40/610
5,169,353 A 12/1992 Myers
6,702,726 B2 * 3/2004 Lin ..... A63B 21/154 446/220
2002/0111109 A1 8/2002 Kwan
(Continued)

FOREIGN PATENT DOCUMENTS

GB 2308074 A 6/1997
WO WO2015022490 A1 2/2015

OTHER PUBLICATIONS

International Search Report and Written Opinion for PCT/US2021/019365, dated May 5, 2021, 12 pages.

*Primary Examiner* — Kien T Nguyen
(74) *Attorney, Agent, or Firm* — Taft Stettinius & Hollister LLP; Gerald E. Helget

(57) ABSTRACT

A reusable, ornamental air-filled balloon structure includes a large, elongate, unbalanced upper ornamental chamber. The chamber has a valve on its bottom for inflating for use and deflating for storage of the balloon structure. A lower base ornamental chamber, that is adapted to rest on a flat surface or plane, has a centralized pocket with an aperture for transversely receiving the bottom of the upper chamber. A hidden valve for inflating the lower chamber for use and deflating for storage is provided. The upper chamber air valve is capable of being passed through the aperture and anchored to the lower chamber to secure the two chambers together while the upper chamber stays in an upright condition ideal for display. Common household filled cans are placed in the hidden centralized pocket to weigh the balloon structure down and keep it in place. The height of the upper ornamental chamber is at least three times taller than the height of the lower base chamber.

16 Claims, 9 Drawing Sheets

(56) References Cited

U.S. PATENT DOCUMENTS

| | | | | |
|---|---|---|---|---|
| 2007/0022642 | A1* | 2/2007 | Hsu | G09F 15/0025 40/419 |
| 2007/0123141 | A1* | 5/2007 | Berkey | A63H 33/006 446/220 |
| 2008/0119107 | A1* | 5/2008 | Song | A63G 13/06 446/220 |
| 2012/0190269 | A1* | 7/2012 | Duncan | A63H 3/06 446/226 |

* cited by examiner

REUSABLE, ANCHORABLE ORNAMENTAL BALLOON STRUCTURE

BACKGROUND OF THE INVENTION

Ornamental balloons or inflatables have been a festive favorite for all special occasions including birthdays, weddings, graduations, holidays and personal celebrations. Ornamental balloons take many shapes as characters, flowers, numbers, props, building structures and virtually anything that has some form of structure. Ornamental balloons may be filled with air or helium and generally require some type of anchoring or tethering system to keep the balloons in place, to prevent a helium balloon from floating upwardly away or to keep an air filled balloon from wandering or blowing away if outside.

In the market place today, over 90% of light-weight inflatables or balloons are filled with helium gas. Helium-filled inflatables and balloons are also generally not reusable. The helium gas leaks out through the special balloon material over time. Generally after a couple of weeks or less, the helium filled balloons are severely deflated, rendered unattractive and useless for their intended purpose.

Air inflatables are typically in spherical latex balloons, pool toys, trampolines and air mattress categories. How to display large decorative air-filled balloons has many challenges. Adhesives and cumbersome tie downs are commonly used but are very ineffective. Exposed tie downs and anchors are also unsightly and unsafe to be around as they cause children to be exposed to tripping and hurting themselves. So a particular concern with all balloons is keeping them in place without distracting their viewing with clumsy strings, tethers, anchors or rigid holders.

There is a need for large decorative and ornamental, air-filled balloons that do not use adhesives, exposed cumbersome tie downs or anchors. Such ornamental large balloons should have a long life, be capable of deflating for storage and later inflating for reuse. Desirably, common household items in combination with a unique ornamental balloon base design with hidden pockets for common household items would keep the ornament balloons in their place inside or outside during normal weather conditions.

SUMMARY OF THE INVENTION

A reusable, ornamental air-filled balloon structure includes a large, elongate, unbalanced upper ornamental chamber. The chamber has a valve on its bottom for inflating for use and deflating for storage of the balloon structure. A lower base ornamental chamber, that is adapted to rest on a flat surface or plane, has a centralized pocket with an aperture for transversely receiving the bottom of the upper chamber. A hidden valve for inflating the lower chamber for use and deflating for storage is provided. The upper chamber air valve is capable of being passed through the aperture and anchored to the lower chamber to secure the two chambers together while the upper chamber stays in an upright condition ideal for display. Common household filled cans are placed in the hidden centralized pocket to weigh the balloon structure down and keep it in place. The height of the upper ornamental chamber is generally at least three times taller than the height of the lower base chamber.

A principal object and advantage of the ornamental air-filled balloon structure of the present invention is that the structure is unusually tall but very stable when inflated and displayed from ground level.

Another object and advantage of the present invention is that the ornamental balloon structure uses air instead of helium which makes its purchase relatively inexpensive, easy to inflate, set up and use for extended use as the air does not readily leak out of the balloon as helium would.

Another object and advantage of the present invention is that the ornamental balloon structure stays in place both indoors and outdoors do to its hidden anchoring system.

Another object and advantage of the present invention is that the ornamental balloon structure is unusually tall wherein the upper ornamental chamber is at least 3 or 4 times taller than the lower base chamber.

Another object and advantage of the present invention is that the ornamental balloon structure is unusually stable wherein the lower ornamental chamber is approximately one-third in width to the height of the upper ornamental chamber.

Another object and advantage of the present invention is that the ornamental balloon structure is of great stability, the ornamental chambers can take on a great variety of shapes and ornamentation for multiple uses heretofore not known.

Another object and advantage of the present invention is that the ornamental balloon structure is the ornamental base chamber can be made with one, two, three, four or more chambers.

Another object and advantage of the present invention is that the ornamental balloon structure may be inflated with air and stays inflated for a long duration and further may be deflated and stored for multiple future uses.

Another object and advantage of the present invention is that the ornamental balloon structure is that the balloon structure may be inflated with air which is heavier than helium so that the ornamental structure has less tendency to float away and requires minimal anchoring.

Another object and advantage of the present invention is that the ornamental balloon structure is that it does not use unsightly and unsafe cumbersome tie downs and anchors making the balloon structure safe for children to play around the structure.

DETAILED DESCRIPTION OF THE FIGURES

FIG. 1I is a front elevational view of another embodiment of the reusable, anchorable ornamental balloon structure of the present invention seated on a flat plane P;

DETAILED SPECIFICATION

Figure 1:
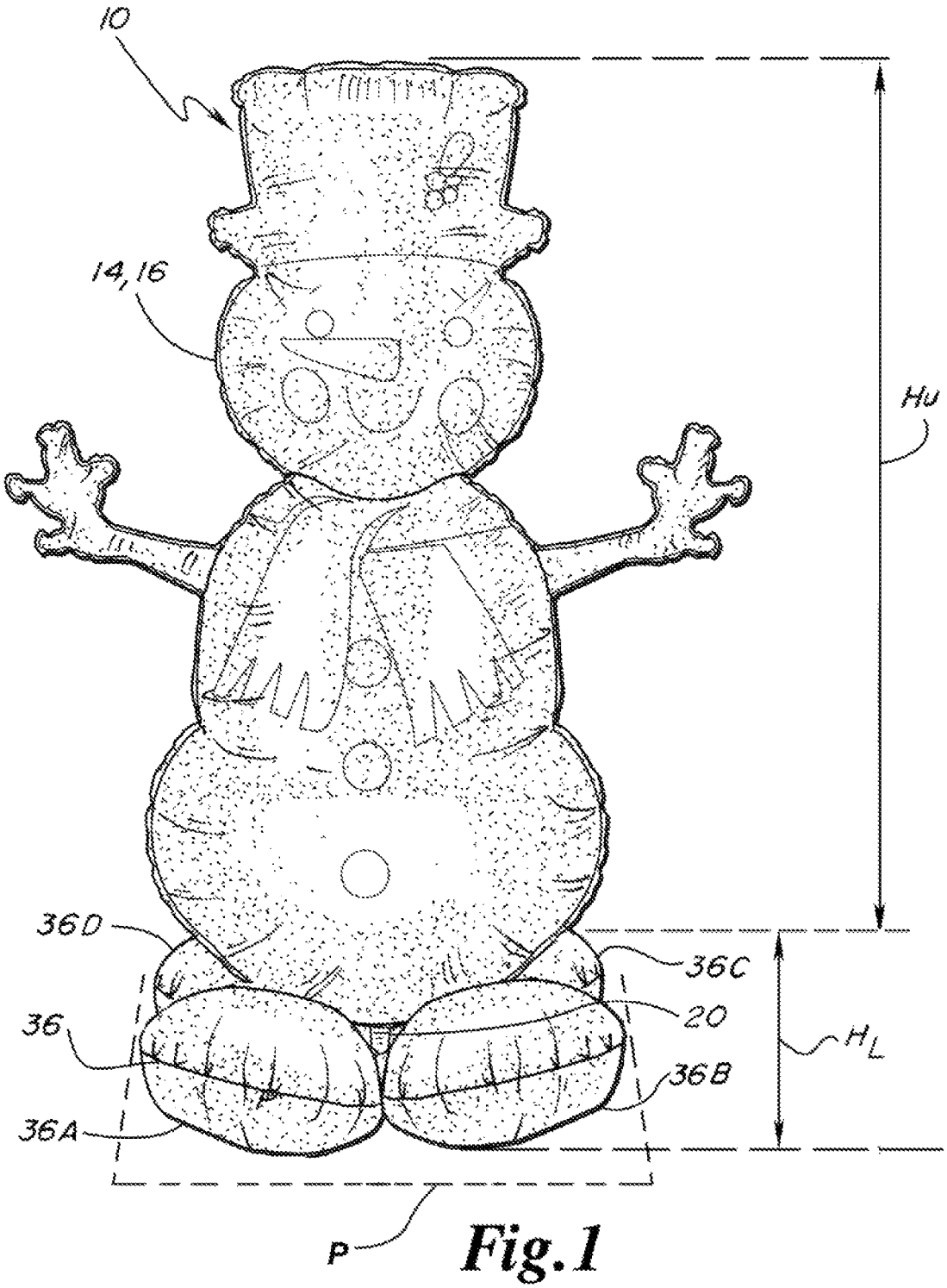
FIG. 1 is a front elevational view of the reusable, anchorable ornamental balloon structure of the present invention seated on a flat plane P.
Figure 2:
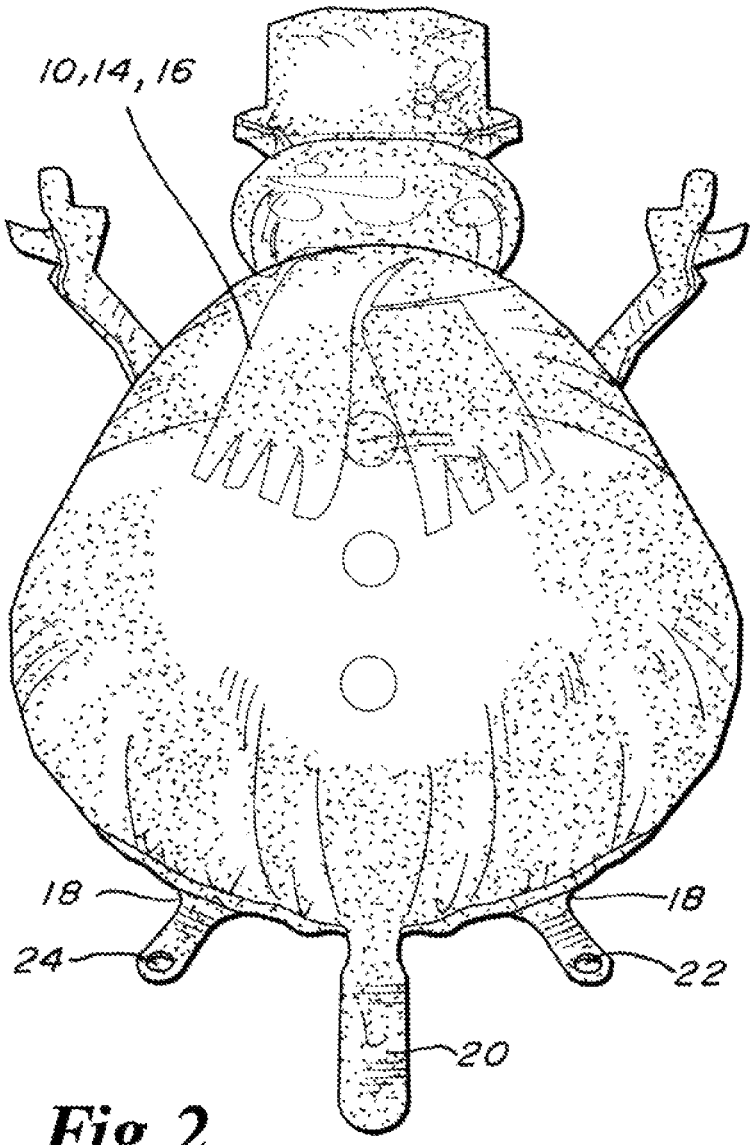
FIG. 2 is a front elevational view of the upper ornamental balloon chamber of the present invention.
Figure 3:
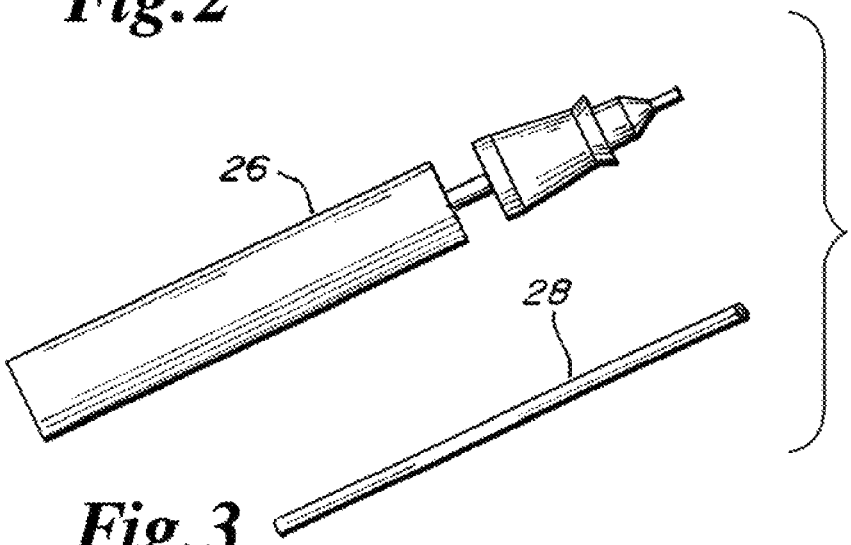
FIG. 3 is a front elevational view of an air pump and a straw typically used for inflating and deflating the ornamental balloon structure.
Figure 4:
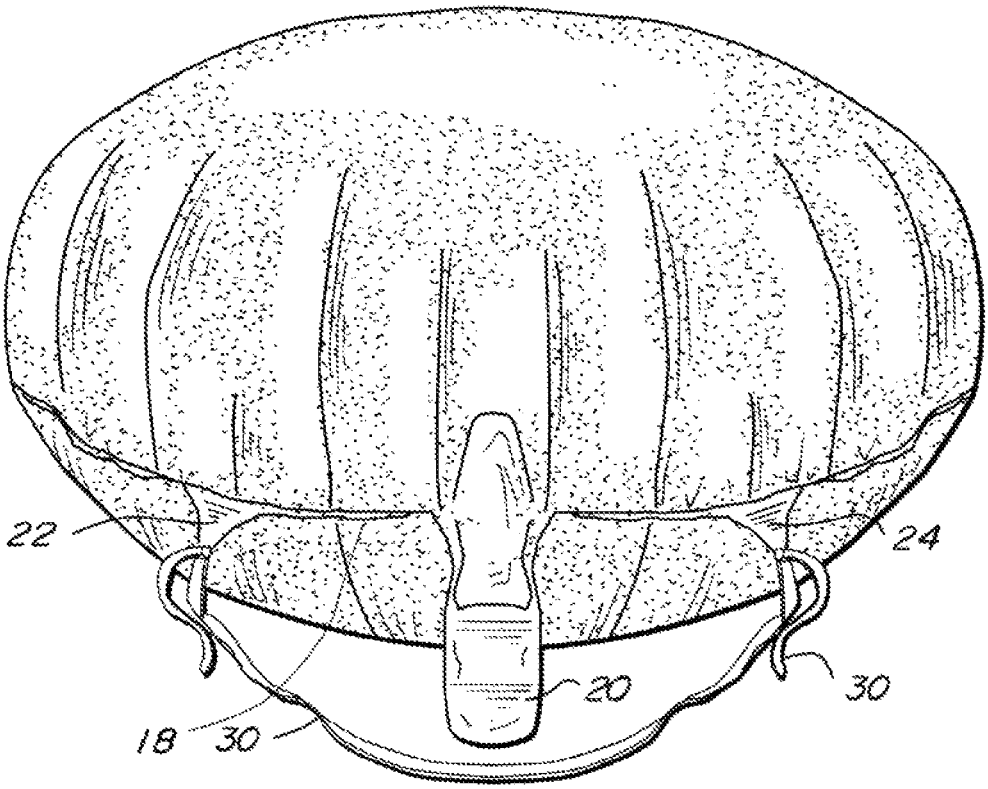
FIG. 4 is a bottom plan view of the upper ornamental balloon chamber of the present invention showing its depending connector tethering system.
Figure 5:
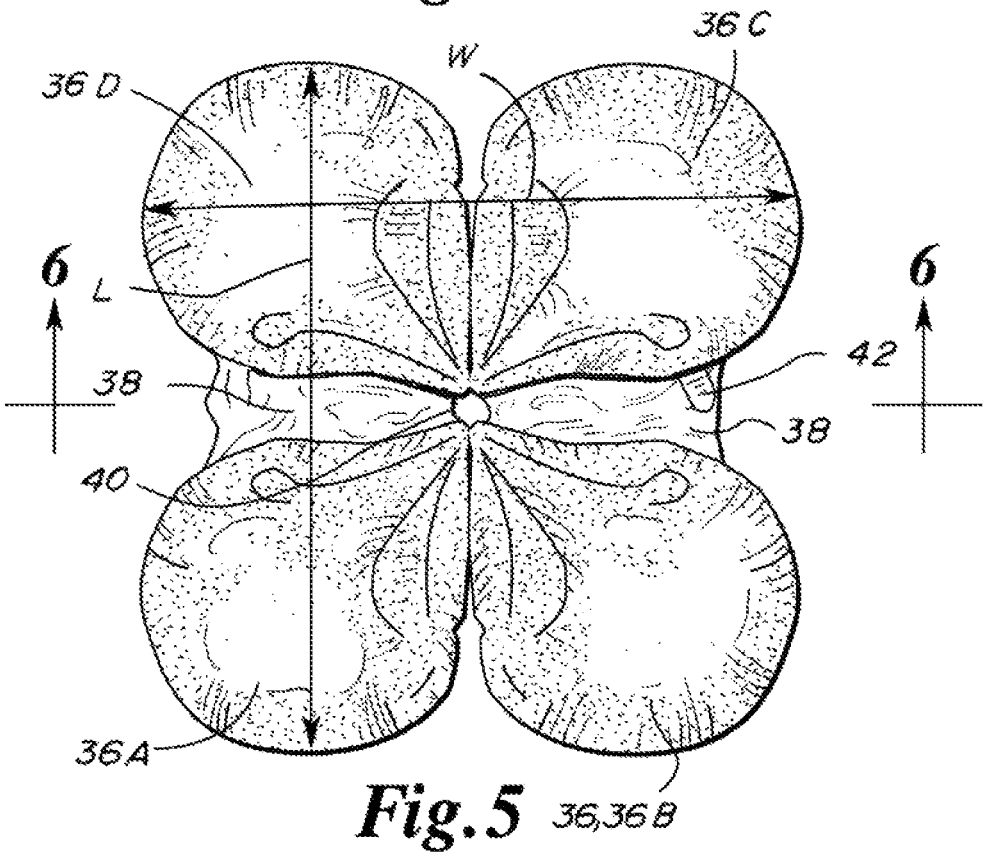
FIG. 5 is a top plan view of the lower base ornamental balloon chamber of the present invention.

Referring to FIGS. 1 through 8, a reusable, anchorable, ornamental balloon structure 10 of the present invention may be seen and understood. The first embodiment of the ornamental balloon structure 10, takes the shape of a snowman ornamental balloon structure 14 with upper and lower ornamental balloon chambers 16 and 36. The ornamental balloon structure 10, 14 may be made of Mylar, also known as BoPET (biaxially-oriented polyethylene terephthalate) which is a polyester film made from stretched polyethylene terephthalate (PET) and is commonly used for its high tensile strength, chemical and dimensional stability, transparency, reflectivity, gas and aroma barrier properties and electrical insulation. Air-filled balloons made of Mylar are made by two identical cut out shapes that are welded at the mating periphery and will stay inflated for more than a month and can be easily re-filled with air.

Upper snowman balloon chamber 16 is elongate and tall, vertically oriented and somewhat unbalanced. Reasonably tall illustratively means the upper chamber may be 50 inches or taller $H_U$. The upper chamber has a curved bottom end 18 and at the central portion of bottom seam is located a depending connector known as an air valve 20 for inflating and deflating the upper chamber 16. Suitable air valves 20 for this invention maybe found disclosed in U.S. Pat. No. 4,917,646. Adjacent the central air valve 20 are left and right depending connector tabs 22, 24 which similarly have stretch cord 30 tied to each tab 22, 24 with some slack therebetween.

To inflate Upper snowman balloon chamber 16, an air pump 26 or straw 28 may be inserted into and through valve 20. Air is pumped or blown into the chamber 16 until it is fairly rigidly inflated. When dis-assembling the balloon structure 14, the straw 28 is simply inserted into and through the valve 20 and the air within the balloon chamber 16 is simply evacuated.

Lower ornamental snowman balloon chamber base 36 may take many shapes and chamber variations having overall width W and length L and a height $H_L$ which illustratively may be approximately 10 inches. Illustrated with the snowman ornamental balloon structure 14, the lower base chamber 36 comprises first subchamber 36A, second subchamber 36B, third subchamber 36C and fourth subchamber 36D. these subchambers may be interconnected by air channels which facilitate and expedite inflation of the chamber base balloon 36. Between chambers 36A and 36D as well as chambers 36B and 36C, is located an un-inflated web or pocket 38 of fused balloon material that extends the width W of the balloon base 36. An aperture 40 is in the center of web 38. An air valve 42 for inflating and deflating the lower balloon chamber 16 is in the lower balloon chamber base 16 and may be hidden on a bottom surface (see FIG. 5).

Figure 6:
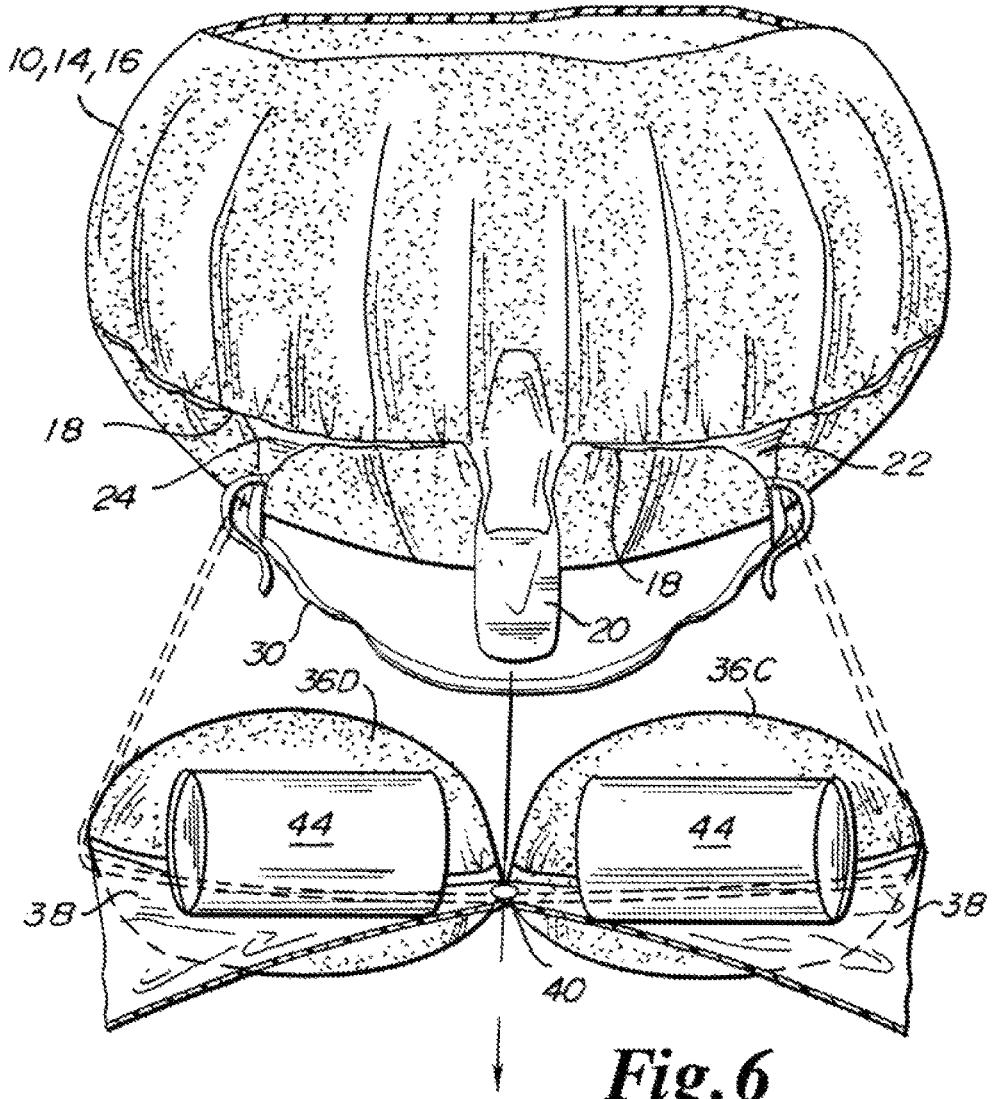
FIG. 6 is an exploded front elevational view of the partially cut away upper ornamental balloon chamber and the lower base ornamental balloon chamber cut away along lines 6-6 of FIG. 5 showing the depending fastening connectors and anchors of the present invention.
Figure 7:
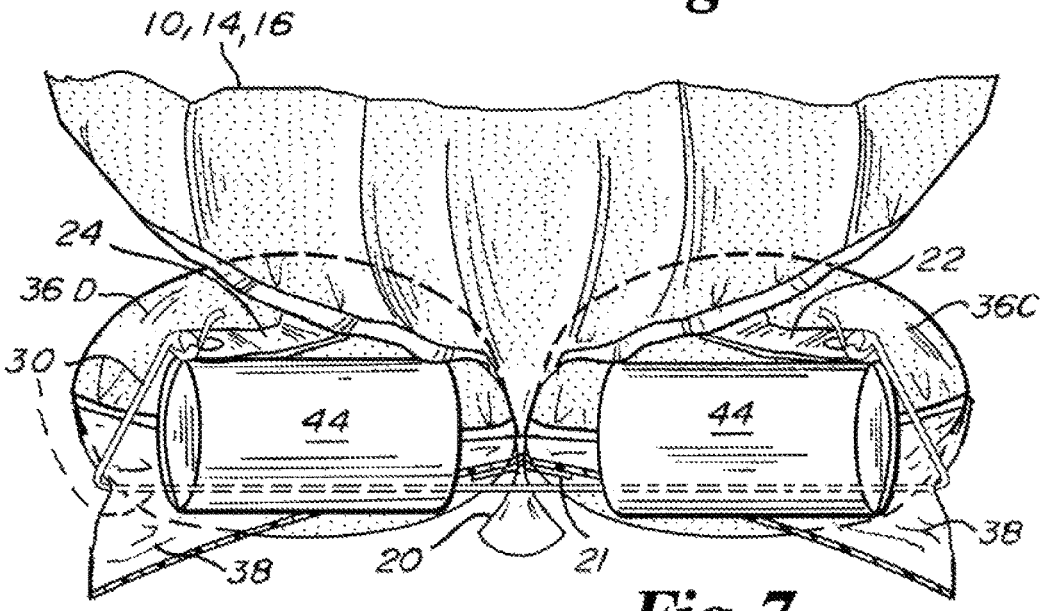
FIG. 7 is a front elevational view of the partially cut away upper ornamental balloon chamber and the lower base ornamental balloon chamber cut away along lines 6-6 of FIG. 5 showing the depending fastening connectors anchoring the upper and lower balloon chambers together and the anchors of the present invention.
Figure 8:
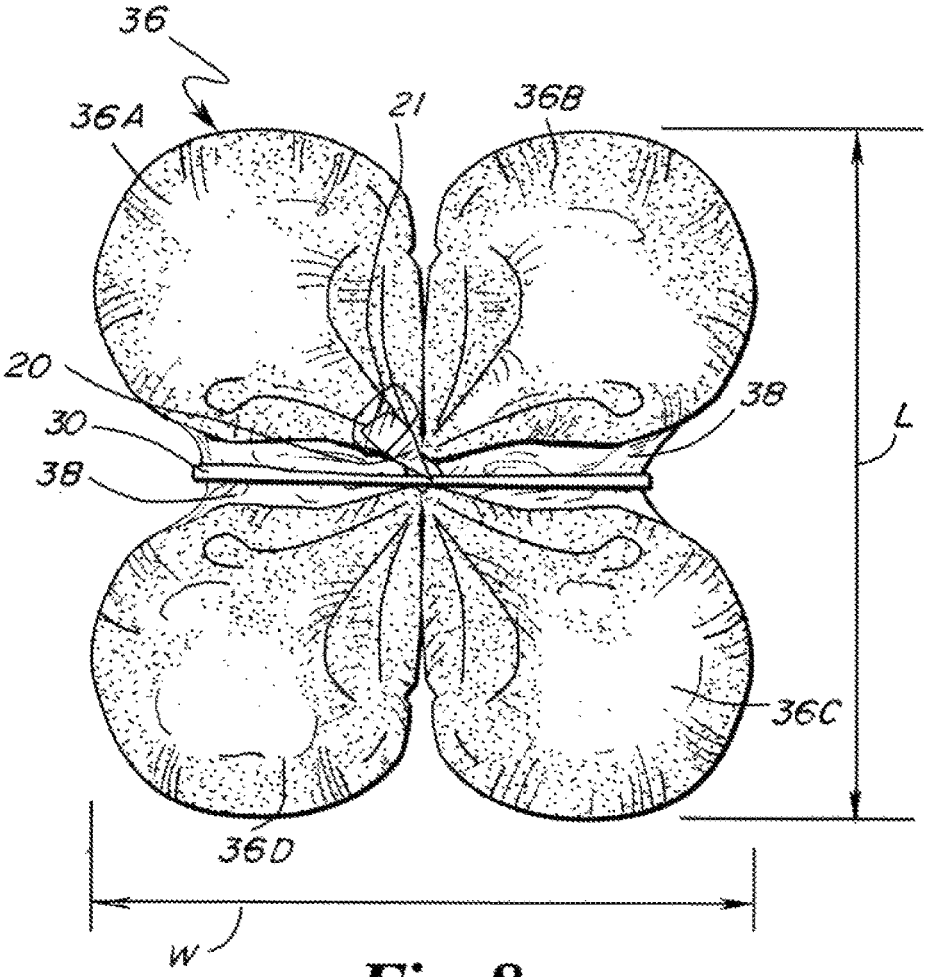
FIG. 8 is a bottom plan view of the lower ornamental balloon base chamber of the present invention showing the depending fastening connectors anchoring the upper and lower balloon chambers together.

To connect the upper ornamental balloon chamber 16 to the lower ornamental base balloon chamber 36 please review FIGS. 6-8. The depending connector or air valve 20 is fed through the aperture 40 of the base chamber 36 and tape 21 is used to fasten the valve 20 to the underbody of the lower base balloon 36 as the bottom 18 of the upper balloon chamber is transversely nestled into the web 38 of the lower balloon chamber 36. Next the stretch cord 30 is lifted over the front chambers 36A and 36B or over rear chamber 36C and 36D and released to snap into the depression up against the underside of the web 38. Some manual adjusting of the upper and lower chambers 16 and 36 may be needed to make sure the upper chamber stand vertically upright and is securely fastened into the web 38. Weights 44 may be positioned on the web (or pocket) 38 to hold the balloon structure 14 in place for indoor and outdoor usage. Weights 44 may be canned ordinary household drinks or foods items such as pop cans or vegetable cans. By this arrangement, the snowman ornamental balloon structure 14 is closely held together. The balloon base 36 siting on the ground floor (plane P) supports the upper chamber 16 in steady upright condition in a light wind without tie-downs or external anchors. Adding weight 44 to the web or pocket 38 only further adds stability to the ornamental snowman balloon structure 14.

Disassembly is generally the reverse of assembly just above. The stretch cord 30 is lifted out from under the lower base chamber 36. The air valve 20 has its tape removed from the lower base chamber 36 and is pulled through the aperture 40 to free the upper chamber 16 from the lower base chamber 36. The straw 28 is then inserted to valves 20 and 42 and the air within the upper and lower chambers 16 and 36 is evacuated and the chambers 16 and 36 are rolled up or folded till next usage.

Figure 10:
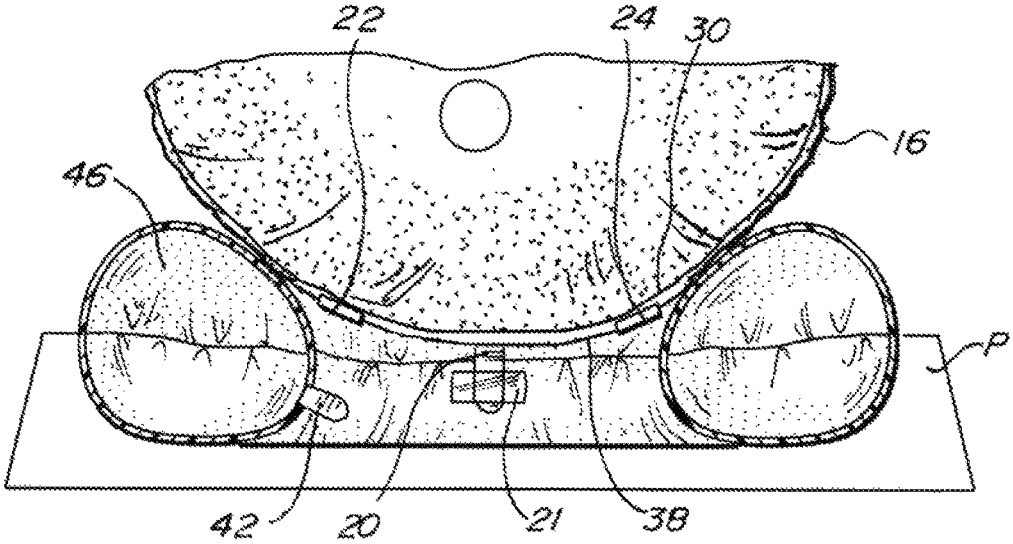
FIG. 10 is a front elevational view of the partially cut away upper ornamental balloon chamber and the lower base ornamental balloon chamber of FIG. 9 cut away similarly to and along lines 6-6 of FIG. 5 showing a depending fastening connector or air valve anchoring the upper and lower balloon chambers together.
Figure 9:
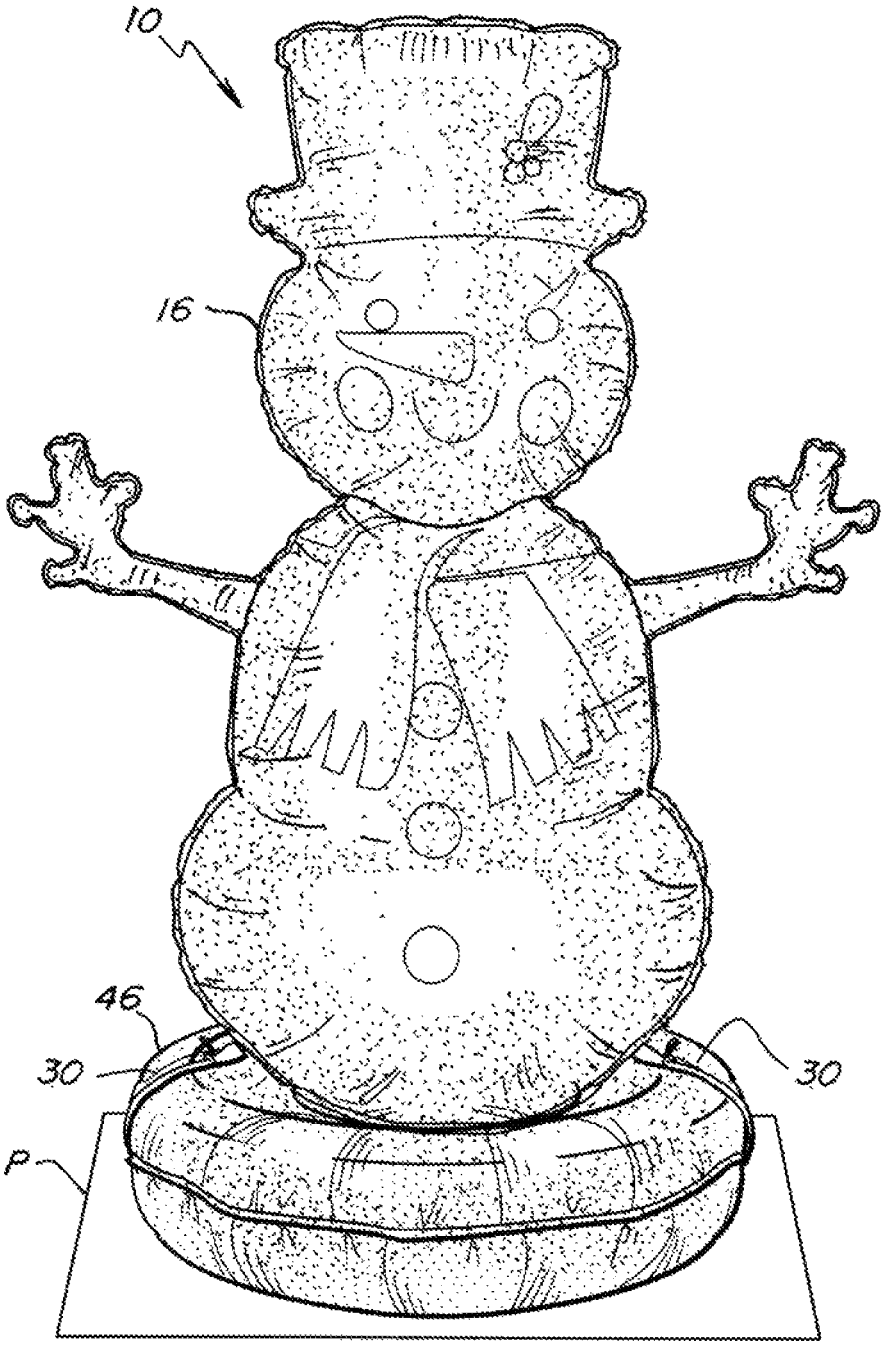
FIG. 9 is a front elevational view of the upper ornamental balloon chamber and another embodiment of the lower base ornamental balloon of the present invention.

FIGS. 9 and 10 illustrates another embodiment of the lower ornamental balloon base that is a 'donut shaped' single chamber 46. Generally all the parts and limitations of the first embodiment of a snowman ornamental balloon structure 14 are present to include upper ornamental balloon chamber 16 and lower ornamental balloon base chamber 46 (similar to base chamber 36).

Figure 11:
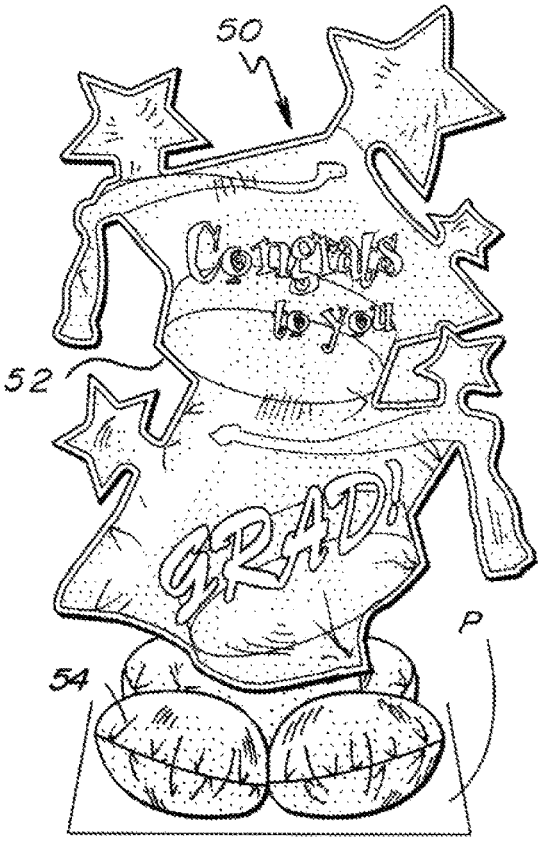
Figure 12:
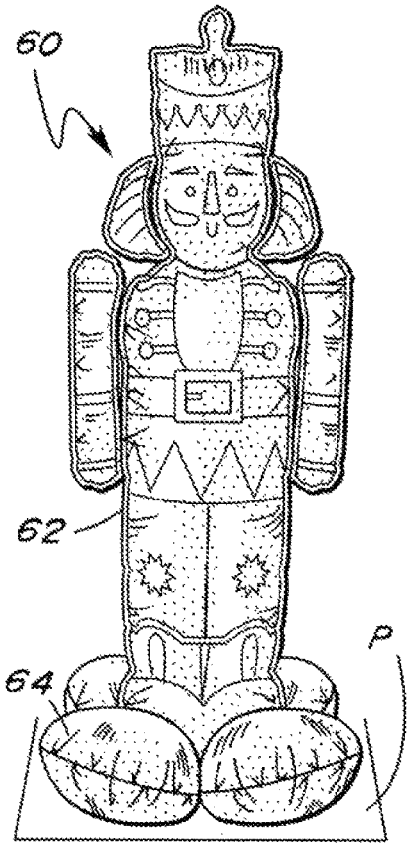
FIG. 12 is a front elevational view of another embodiment of the reusable, anchorable ornamental balloon structure of the present invention seated on a flat plane P.
Figure 13:
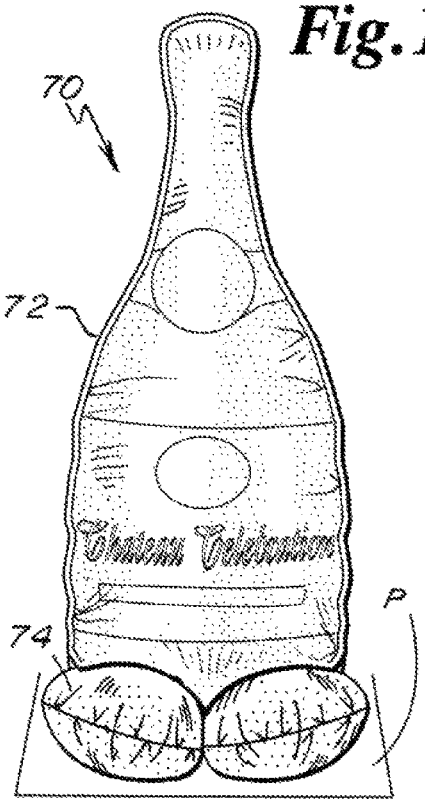
FIG. 13 is a front elevational view of another embodiment of the reusable, anchorable ornamental balloon structure of the present invention seated on a flat plane P.
Figure 14:
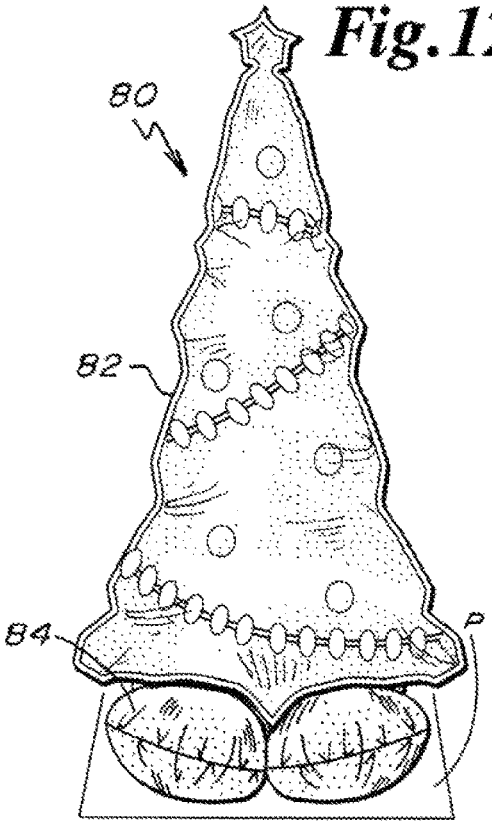
FIG. 14 is a front elevational view of another embodiment of the reusable, anchorable ornamental balloon structure of the present invention seated on a flat plane P.
Figure 15:
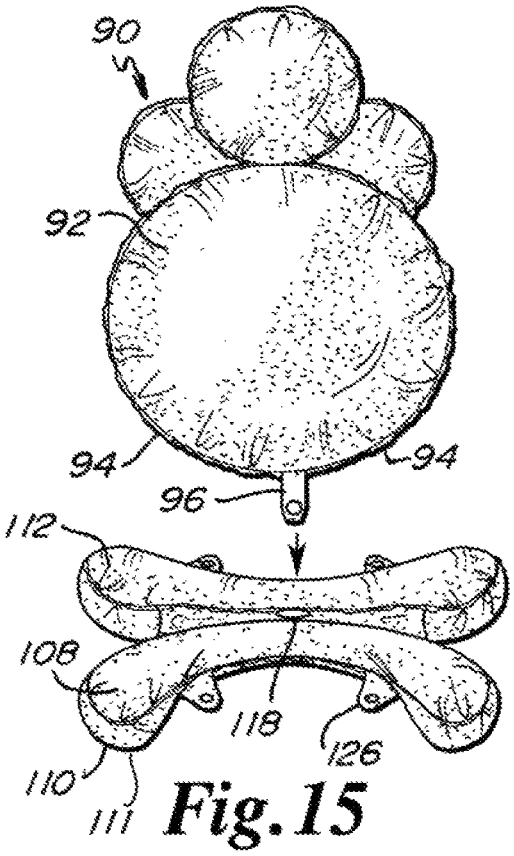
FIG. 15 is an exploded front elevational view of another embodiment of the reusable, anchorable ornamental balloon structure of the present invention.
Figure 16:
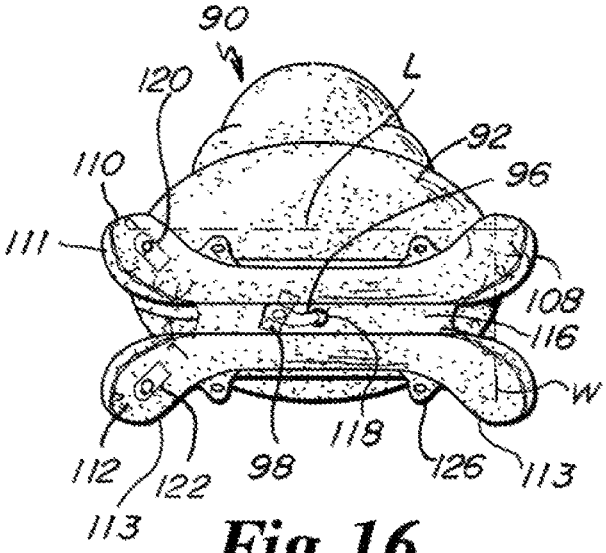
FIG. 16 is a bottom plan view of the embodiment of the reusable, anchorable ornamental balloon structure of FIG. 15 the present invention.
Figure 17:
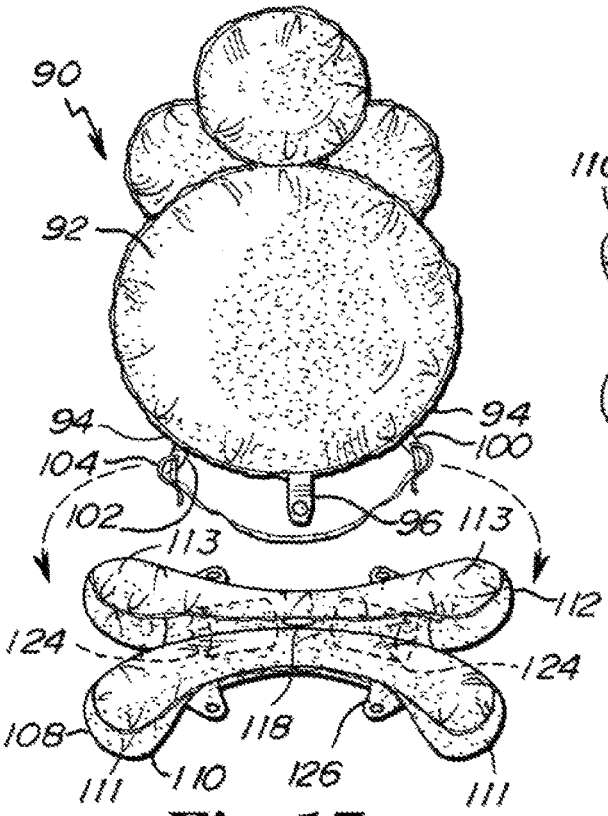
FIG. 17 is an exploded front elevational view of the embodiment of the reusable, anchorable ornamental balloon structure of FIG. 15 showing its depending connectors.
Figure 18:
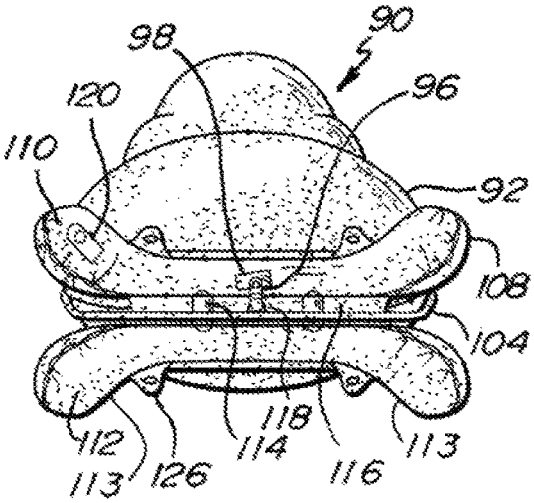
FIG. 18 is bottom plan view of another embodiment of the reusable, anchorable ornamental balloon structure of FIG. 15 showing its depending connectors connecting the upper and lower base chambers.

FIG. 11 shows additional ornamental balloon structure 10 to include a graduation ornamental balloon structure 50 which has an upper ornamental graduation themed balloon chamber 52 and lower ornamental balloon chamber 54 as well as the elements and parts of snowman balloon structure 14 sitting on a flat plane P. FIG. 12 shows additional ornamental balloon structure 10 to include a Nutcracker toy solder ornamental balloon structure 60 which has an upper ornamental Nutcracker toy soldier themed balloon chamber 62 and lower ornamental balloon chamber 64 as well as the elements and parts of snowman balloon structure 14 sitting on a flat plane P. FIG. 13 shows additional ornamental balloon structures 10 to include a champagne bottle ornamental balloon structure 70 which has an upper bottle ornamental champagne bottle themed balloon chamber 72 and lower ornamental balloon chamber 74 as well as the elements and parts of snowman balloon structure 14 sitting on a flat plane P. FIG. 14 shows additional ornamental balloon structure 10 to include a Christmas tree ornamental balloon structure 80 which has an upper ornamental Christmas tree themed balloon chamber 82 and lower ornamental balloon chamber 84 as well as the elements and parts of snowman balloon structure 14.

Ornamental balloon structures 10 of snowman 14, graduation 50, Nutcracker toy soldier 60, champagne bottle 70 and Christmas tree 80 are all reusable and invisibly anchorable with household goods as weights 44. They each are relative tall in that the upper balloon chambers are approximate 50 inches or tall while the lower balloon chambers are approximately 10 inches high. This means that the upper balloon chambers are three to five times taller than the lower base chambers. In other words, the base chambers are one fifth to one third smaller than the upper chambers. By this arrangement, the ornamental balloon structures 10, 14, 50, 60, 70 and 80 are real-life-size in a range approximating sixty inches. The length L and width W (FIGS. 5 and 8) of the lower base balloon chambers 36, 46, 54, 64, 74 and 84 are approximately twenty-four inches each. This size of the base balloon chamber creates its stability as it solidly rests on a flat horizontal plane P. So the base balloon chambers have a width and a length of approximately twenty-four inches or about one-third of the height of the upper ornamental balloon chambers. Adding the weights 44 further increase the stability of the structures to stand uprightly without ugly tie-downs or exposed weights indoors or outdoors in fair conditions. Children appreciate these sizes as they play with, run-around and hug the structures 10, 14, 50, 60, 70 and 80—all without ugly, unsightly and unsafe tie-downs or external anchors.

Referring to FIGS. 15-18, another embodiment of a reusable anchorable ornamental balloon structure 90 may be seen. This embodiment of the reusable, anchorable ornamental balloon structure 90 is generally shorter in stature than previous ornamental balloon structures 10, 14, 50, 60, 70 and 80. The ornamental balloon structure 90 includes an upper ornamental chamber 92 with a bottom having depending connector air valve 96 for adding and removing air from the balloon to be taped to the lower ornamental chamber 108 after being passed through aperture 118. Upper balloon chamber 92 also has bottom depending connectors in the form of left and right tabs 100, 102 for securement of stretch cord 104 to tabs 100, 102.

Lower ornamental balloon chamber 108 is of a slightly different embodiment. It has a first front chamber 110 and a second rear chamber 112 which may be independent from each other or joined by interconnecting channels 114. Each chamber 110 and 112 have distal end turned out feet 111 and 113 to increase the stabilization of the lower balloon chamber without adding significant width or length as to balance the transversely mounted upper ornamental chamber 92.

Figure 19:
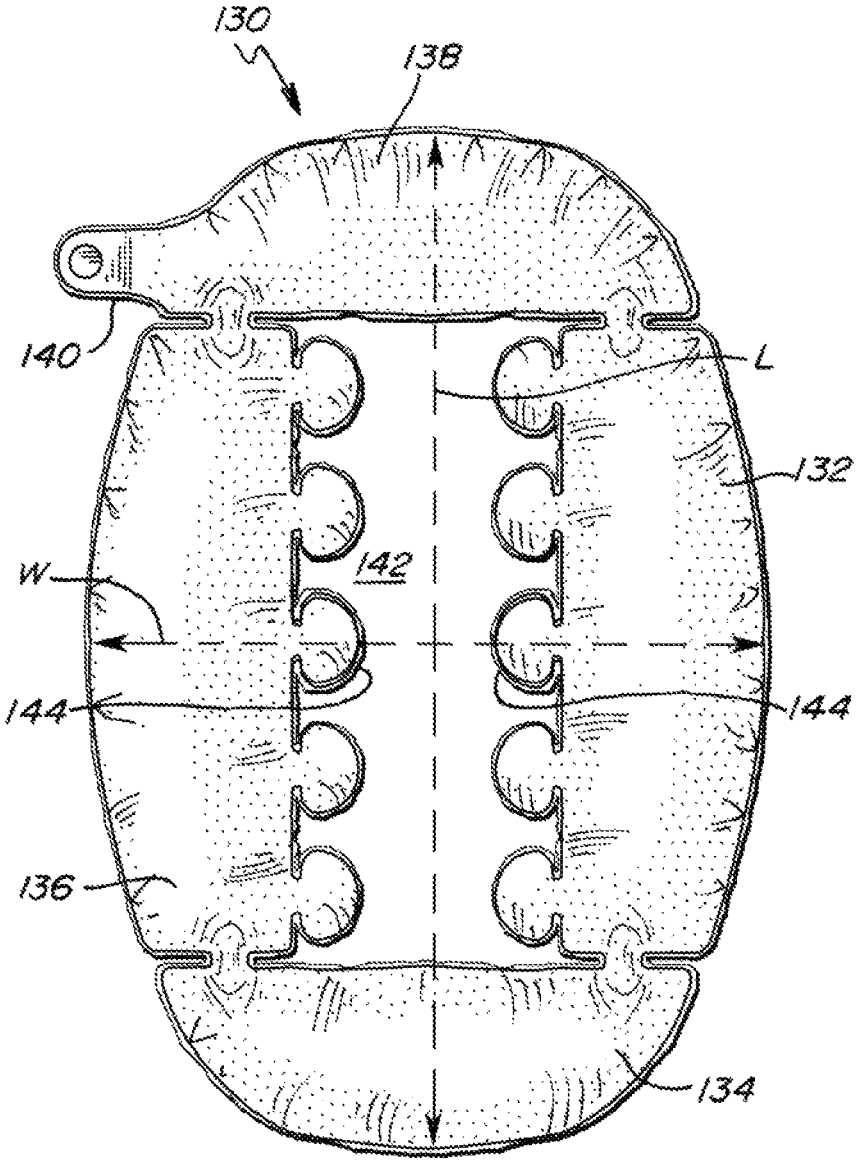
FIG. 19 is a top plan view of another embodiment of the lower base ornamental balloon chamber of the present invention.

FIG. 19 shows another embodiment of an oval-shaped lower ornamental chamber base 130 with four chambers 132, 134, 136 and 138 which may or may not be interconnected with a single air valve 140. Base 130 has a central opening 142 with inwardly protruding and opposing inflatable knobs 144. The upper ornamental balloon chamber may be forced into the central opening 142 and held there in place by friction with the opposing inflatable knobs 144. Additionally, the valve of the upper balloon chamber may be taped to the base chamber 130 as previously described.

The above specification and FIGS. are for illustrative purposes only. The true scope of the present invention being defined by the following claims.

What is claimed:

1. A reusable, anchorable ornamental balloon structure, comprising:

a) an elongate, unbalanced upper ornamental chamber having a first height, the upper ornamental chamber will not stand upright on its own with a valve for inflating the upper chamber for use and deflating the upper chamber for storage, having a bottom with at least one depending connector;

b) a lower base ornamental chamber having a second height, a width and a length forming a bottom most plane adapted to rest on a flat surface and a centralized pocket for transversely receiving the bottom of the upper chamber, the lower chamber having a valve for inflating the lower chamber for use and deflating the lower chamber for storage;

c) a fastener connecting the depending connector to the lower ornamental chamber as to hold the upper ornamental chamber in an upright condition; wherein the depending connector comprises two tabs at the bottom of the upper ornamental chamber; and a stretchable cord with two ends one of each being connected to one of the tabs adapted to transversely wrap around the lower ornamental chamber adjacent to the centralized pocket.

2. The reusable, anchorable ornamental balloon structure of claim 1, wherein the pocket of the lower chamber has a centralized aperture where through the valve in the bottom of the upper chamber passes and is fastened to the lower chamber to secure the upper ornamental balloon to the lower base chamber to support the upper ornamental balloon in vertical condition.

3. The reusable, anchorable ornamental balloon structure of claim 1 wherein the pocket of the lower chamber is adapted to receive weight as to anchor the lower chamber to assist in holding the upper ornamental chamber in an upright condition.

4. The reusable, anchorable ornamental balloon structure of claim 1, wherein the lower base ornamental chamber comprises multiple connected chambers.

5. The reusable, anchorable ornamental balloon structure of claim 1, wherein the height of the upper ornamental chamber is at least 3 times taller than the height of the lower base chamber.

6. The reusable, anchorable ornamental balloon structure of claim 1, wherein the height of the upper ornamental chamber is double the width of the lower chamber.

7. A reusable, anchorable ornamental balloon structure, comprising:

a) an elongate, unbalanced upper ornamental chamber having a first height, the upper balloon chamber will not stand upright on its own with a bottom valve for inflating the upper chamber for use and deflating the upper chamber for storage of the structure and the bottom of the upper chamber having with at least one depending connector;

b) a lower base ornamental chamber having a second height that is ¼$^{th}$ or less of the height of the upper chamber, a width and a length forming a bottom most plane adapted to rest on a flat surface and a centralized pocket for transversely receiving the bottom of the upper chamber, the lower chamber having a valve for inflating the lower chamber for use and deflating the lower chamber for storage of the structure;

c) a fastener connecting the depending connector to the lower ornamental chamber as to hold the upper ornamental chamber in an upright condition; and the pocket of the lower chamber has a centralized aperture where though the valve in the bottom of the upper chamber passes and is fastened to the lower chamber to secure the upper ornamental balloon to the lower base chamber to support the upper ornamental balloon in vertical condition.

8. The reusable, anchorable ornamental balloon structure of claim 7, wherein the depending connector comprises two tabs at the bottom of the upper ornamental chamber.

9. The reusable, anchorable ornamental balloon structure of claim 7, further comprising a stretchable cord with two ends one of each being connected to one of the tabs adapted to transversely wrap around the lower ornamental chamber adjacent to the centralized pocket.

10. The reusable, anchorable ornamental balloon structure of claim 7 wherein the pocket of the lower chamber is adapted to receive weight as to anchor the lower chamber to assist in holding the upper ornamental chamber in an upright condition.

11. The reusable, anchorable ornamental balloon structure of claim 7, wherein the lower base ornamental chamber comprises multiple connected chambers.

12. The reusable, anchorable ornamental balloon structure of claim 7, wherein the height of the upper ornamental chamber is double the width of the lower chamber.

13. A reusable, anchorable ornamental balloon structure, comprising:

a) an elongate, unbalanced upper ornamental chamber having a first height, the upper balloon chamber will not stand upright on its own with a bottom valve for inflating the upper chamber for use and deflating the upper chamber for storage of the structure, and having two tabs at the bottom;

b) a lower base ornamental chamber having a second height, a width and a length forming a bottom most plane adapted to rest on a flat surface and a centralized pocket for transversely receiving the bottom of the upper chamber, the lower chamber having a valve for inflating the lower chamber for use and deflating the lower chamber for storage of the structure, wherein the pocket of the lower chamber has a centralized aperture where through the valve in the bottom of the upper chamber passes and is fastened to the lower chamber to secure the upper ornamental balloon to the lower base chamber to support the upper ornamental balloon in vertical condition; and c) two tabs at the bottom of the upper chamber and a stretchable cord with two ends one of each being connected to one of the tabs adapted to transversely wrap around the lower ornamental chamber adjacent to the centralized pocket as to hold the upper ornamental chamber in an upright condition, wherein the height of the upper ornamental chamber is at least 4 times taller than the height of the lower base chamber.

14. The reusable, anchorable ornamental balloon structure of claim 13 wherein the pocket of the lower chamber is adapted to receive weight as to anchor the lower chamber to assist in holding the upper ornamental chamber in an upright condition.

15. The reusable, anchorable ornamental balloon structure of claim 13, wherein the lower base ornamental chamber comprises multiple connected chambers.

16. The reusable, anchorable ornamental balloon structure of claim 13, wherein the height of the upper ornamental chamber is double the width of the lower chamber.

* * * * *